United States Patent [19]

Clark

[11] Patent Number: 4,690,021

[45] Date of Patent: Sep. 1, 1987

[54] AUTOMATIC LOAD UNLOAD TURRET PUNCH

[75] Inventor: Stephen C. Clark, Clemson, S.C.

[73] Assignee: Strippit/Di-Acro-Houdaille, Inc., Akron, N.Y.

[21] Appl. No.: 777,872

[22] Filed: Sep. 20, 1985

Related U.S. Application Data

[63] Continuation of Ser. No. 52,241, Jun. 26, 1979, abandoned, which is a continuation of Ser. No. 815,821, Jul. 15, 1977, abandoned.

[51] Int. Cl.[4] ..... B21D 43/11; B21D 43/22; B21D 43/24

[52] U.S. Cl. ..... 83/71; 83/23; 83/157; 83/367; 83/412; 83/552; 271/223

[58] Field of Search ..... 83/23, 71, 412, 413, 83/157, 367, 552; 271/171, 223, 224

[56] References Cited

U.S. PATENT DOCUMENTS

| | | | |
|---|---|---|---|
| 3,256,761 | 6/1966 | Huntley | 83/412 |
| 3,631,750 | 1/1972 | Hanni | 83/157 |
| 3,785,231 | 1/1974 | Lake et al. | 83/157 X |
| 3,830,121 | 8/1974 | Makeev et al. | 83/71 X |
| 4,014,230 | 3/1977 | Eisele | 83/157 |
| 4,080,855 | 3/1978 | De George et al. | 83/71 |

*Primary Examiner*—Donald R. Schran

[57] ABSTRACT

An automatic material loading, positioning and unloading system is disclosed in connection with a machine tool turret punch. The device includes a loader which receives a stack of sheets to be fed to the punch machine. The loader includes means for lifting the sheets one at a time from a storage area, means for transporting the sheets to a loading area of the punch worktable and means for unloading the sheets at the worktable area. The punch machine includes automatically controlled workpiece grippers which receive the sheets from the loader, properly position them with respect to the machine tool, move them in a predesired sequence through the machine and transport them to an unload area of the worktable. The unload area of the worktable is effective to discharge the punched sheets from the machine to an unload stacker. The unload stacker receives and stacks completed sheets. The loader, grippers, turret punch, unload area and unload stacker all cooperate together to provide a fully automatic machine tool device capable of operating under automatic control to process a large number of workpieces one at a time.

18 Claims, 10 Drawing Figures

AUTOMATIC LOAD UNLOAD TURRET PUNCH

This is a continuation of application Ser. No. 052,241, filed June 26, 1979, which is a continuation of Ser. No. 815,821 filed 7/15/77, now abandoned.

BACKGROUND OF THE INVENTION

1. Field of the Invention

This invention relates to machine tools and more particularly to an automatic workpiece handling system including a machine tool, an automatic workpiece loader for the tool, automatic workpiece positioning means and an automatic completed workpiece unloader.

2. Prior Art

In recent years automated machine tools have become widespread. A particularly successful automation has occurred in connection with high speed turret punches. These punches include relatively large devices having upper and lower spaced apart tool carrying turrets which are maintained in position adjacent a workpiece supporting worktable. The worktable may be equipped with workpiece gripping members which are capable of moving a workpiece in both an X and Y axis with respect to a work station of the turrets. Both the workpiece gripping members and the turrets are controlled from an automatic control center, either a tape read system or a computer such that once a workpiece is properly positioned in the workpiece gripping members and the members properly positioned with respect to the work station, the machine tool can perform a large number of sequential punching operations on the workpiece at precisely determined positions. Upon completion of the desired sequence of punching operations (piece program), the gripping members are normally programmed to return the completed workpiece to a position on the worktable which facilitates unloading of the completed workpiece and loading of a new workpiece.

As such automated turret punches became increasingly improved, it has become practical to operate them totally unattended from the time of initial loading and positioning of the workpiece until completion of the piece program. However, loading, positioning and unloading of successive workpieces remains a manual operation which both adds an unnecessary cost to the manufacture of a large number of identically punched parts while at the same time reduces the manufacturing speed attainable.

Therefore, it would be an advance in the art to provide some construction embodying a machine tool such as a turret punch which was capable of automatically self-loading and unloading. However, due to the criticality of positioning of the workpiece with respect to the work station of the machine, it has not heretofore been practical to contemplate automatic loading devices. Additionally, because of the size of the workpiece will vary from production run to production run, normal product handling systems are not adaptable to automatically load machine tools. An additional factor which works against any attempt to provide an automatic load system results from the fact that machine tools, and particularly turret punches, work with large, unwieldy and heavy workpieces. For example, presently available standard turret punches can handle mild steel sheets on the order of 40" by 96" by ¼" having a weight per sheet of approximately 270 pounds. A more popular size of workpiece may involve sheets on the order of 40" by 60" of 10 gauge mild steel which would weigh on the order of 100 pounds a sheet.

Because of the common usage of such awkward sheet sizes and the weight thereof, it has previously been suggested to provide loading assistance devices. Such prior devices have normally involved constructions which would assist the worker in lifting or dragging a workpiece onto the machine tool worktable. One such prior art device included pneumatic sheet attaching means attached to cables which terminated at a position overlying a portion of the worktable. While such devices have heretofore been useful in assisting in loading large, uniform sized, workpieces, they have neither been automated nor adaptable to varying workpiece sizes.

Additionally, such prior art loaders have not functioned as time saving devices in that upon placing the workpiece on the worktable, the workpiece still had to be moved into the proper position with respect to the workpiece gripping members and the workpiece positioning side guage. Additionally the operator had to raise and lower the side gauge and open and close the workpiece grippers before the piece program could be initiated.

Prior art automatically controlled machine tools utilize workpiece gripping members which are movable in an X and a Y direction with respect to the work station centerline. The control device keeps track of the position of the workpiece gripping members and can therefore be said to know the position of the workpiece with respect to the work station once the workpiece has been properly initially positioned and clamped in the gripping members. This initial positioning has normally been accomplished by causing the gripping members to move over the worktable to an initial load position which is known within the controller as the X and Y axis base line or 0 position. The workpiece is then placed on the table in front of the gripping members and the gripping members are cycled to an open position. Since the workpiece is generally rectangular having at least one pair of right angle adjacent sides, positioning, or gauging, is accomplished by moving the front edge of the workpiece backwards into the open grippers until that edge bottoms in each of the grippers. The workpiece is then moved sideways in the grippers until its side edges adjacent the front edge received in the grippers, encounters a fixed abutment precisely positioned on the worktable. The abutment is normally manually projected above the table surface. At this point, with the front edge bottomed in the grippers and the side edge abutting the side guage projection, the positioning of the workpiece is determined and in view of the control's knowledge of the positioning of the grippers, the control can now be said to have knowledge of the positioning of the workpiece. The grippers are then manually closed and the side guage manually lowered.

Upon completion of the piece program, it has been known in the art to have unloading assists which, in the manner of the loading assists, grab the completed workpiece and drag it off of the worktable. However the prior art had not been able to automate such devices and relied upon the operator to assure that the workpiece was free of obstruction by elements of the machine including the gripping members and to initiate actuation of the unload assist.

Thus, although the actual sequencing of the workpiece through the punching operation, the selection and alignment of the punches and termination of the operation were all automated, the art has not been able to eliminate the necessity for a full time operator who is required to move the workpiece onto the table, whether assisted or unassisted by machinery, to align the workpiece with respect to the machine in both the X and Y axis, to secure the aligned workpiece to the workpiece gripping members, to clear the workpiece side guage, to initiate the piece program cycle, to disengage the workpiece from the gripping members, to clear the workpiece from obstruction by the machine and to remove the workpiece from the workpiece table whether assisted or unassisted by machinery.

It would therefore be an advance in the art to provide a substantially completely automated machine tool assembly having means for: isolating a workpiece from a workpiece storage, moving the isolated workpiece to the machine tool worktable, gripping the workpiece by the workpiece gripping members, gauging the workpiece in both the X and Y axis, sequencing the workpiece and the machine tool through the piece program of the machine tool for that workpiece, disengaging the workpiece from contact with the machine tool and unloading the workpiece from the machine tool worktable to a finished product storage area and repeating the sequence without any intervening operator assistance.

SUMMARY OF THE INVENTION

This invention overcomes the disadvantages of the above described prior art and provides such a fully automated machine tool system. The system, in the preferred embodiment, as hereinafter described, includes a machine tool turret punch of the type which has a workpiece gripping carriage including gripping members movable in an X axis, the gripping carriage being carried by the tool in association with moving worktable portions movable in the Y axis. Movement of the carriage, moving worktable portions and turret indexing and punch operation are all controlled by an NC controller.

To this presently available system, this invention associates a loading device, an X axis guage system, a Y axis gauge system and an unloading device all of which are controlled by the NC and which interact together to virtually eliminate the necessity of a full time machine operator.

As more fully described in connection with the description of the preferred embodiment, I have determined that a critical aspect of a fully automated load-work-unload system is the ability to properly position the workpiece with respect to the machine tool before initiation of the piece program. Further, I have determined that this positioning is preferably independent of the loading mechanism. By making the positioning independent of the loading mechanism, I have avoided the extremely difficult problems associated with creation of a loading device capable of handling a wide variety of sizes and weights of workpieces and positioning them all accurately on the worktable.

Instead, I have provided a versatile loading device capable of picking up workpieces one at a time from a stack of workpieces and depositing them in a given general area of the worktable. Thereafter I accurately position the workpiece with respect to the machine tool by use of the same gripping mechanism which will thereafter move the workpiece during the production sequence.

Further, I have found that unloading can be easily accomplished by causing the workpiece gripping members, upon completion of the piece program, to move the workpiece to a predetermined area of the table, clear of any machine tool overhang and to thereafter deposit the completed workpiece on that area of the table and to withdraw from contact with the workpiece. Thereafter the unload of the workpiece can be accomplished without further reference to either the machine tool or the workpiece gripping members or to the loading device. In fact, in the preferred embodiment illustrated, loading can occur simultaneously with unloding since the functions are carried out on opposite sides of the worktable.

The loading device preferably includes a frame defining an internal stack area for receipt of a pallet containing a stack of workpieces. Mounted atop the frame, and above the stack is a linearly movable carriage including a rail cantilevered from the frame to a position over the worktable at one side of the machine tool center line, the carriage being movable from over the stack to over the worktable. The carriage supports a vertically movable head which carries a number of workpiece engaging pneumatic cups. The loading device functions to load individual sheets from the stack by allowing the head to descend to engage the top workpiece in the stack by the cups, thereafter applying a suction and then raising the head to position the workpiece at a level slightly above the surface of the worktable. The carriage is then transported to a position over the worktable where the head descends to place the workpiece on the worktable. Suction is terminated and the workpiece is disengaged from the cups. Gauging in the Y axis is then carried out. The head thereafter is withdrawn towards the carriage and the carriage is withdrawn to a position over the stack within the frame. X axis gauging is then carried out.

The workpiece is positioned, or gauged, by first moving the workpiece gripping carriage in both the X and Y axis to a known base position adjacent the area of deposit of the workpiece. The gripping members are thereafter moved in the Y axis with the clamps open, a predetermined distance. At that distance the presence of the workpiece edge in engagement with the clamping members is sensed and the clamps are closed. This movement of the clamping members in the Y axis direction and sensing of the presence of the workpiece in the clamps at a known position on the Y axis automatically positions the workpiece in the Y axis.

Positioning of the workpiece in the X axis is accomplished by moving the workpiece gripping members with the Y axis positioned workpiece held by the gripping members in the X axis until the workpiece is engaged against a movable stop member. Engagement of the workpiece against the movable stop member causes the movable stop member to move to a known position, at which position the X axis reference can be set in the gripping carriage movement control. This setting of the X axis direction reference thus properly positions the workpiece along the X axis.

A particularly preferred mechanism for setting the X axis positioning is described in the co-pending application of Robert Paul DeGeorge, Paul Rice Brown and Victor Thomas Carbone, Ser. No. 720,803, filed Sept. 7, 1976.

After precisely determining the proper positioning of the workpiece, the workpiece can, as is normal, be moved through a piece program sequence with respect to the machine tool. Upon completion of the production sequence, the workpiece gripping members are programmed to move the completed workpiece to a side portion of the worktable, preferably opposite the loading side. The workpiece is then deposited upon the table portion in an area where the workpiece is free of any machine tool overhang. Thereafter the gripping carriage is withdrawn to a point remote from the workpiece at which point a signal is sent to the NC control allowing actuation of an unloading device.

In the preferred embodiment described herein the unloading device consists of a hinged side section of the worktable which is provided with a power means for tilting the section to an edge down position (tip table section). Since the worktable is normally equipped with anti-friction devices such as roller balls, the completed workpiece will roll off of the tilted portion of the table and into a sheet stacking device which automatically stacks finished sheets onto a pallet.

The preferred embodiment of the tip table is fully described in the co-pending application of Robert P. DeGeorge and Paul R. Brown, Ser. No. 719,825, filed Sept. 2, 1976, now U.S. Pat. No. 4,080,855 the teachings of which are herein incorporated by reference.

Operation of the loading device, gauging or positioning of the workpiece with respect to the machine tool, piece program and unloading are all controlled by the NC. Additionally the system is provided with a number of inhibits preventing actuation of certain portions in dependent response to sensed conditions existing in other portions.

It is therefore a principal object of this invention to provide a fully automated machine tool capable of self-loading, self-aligning, workpiece production and self-unloading.

It is a more particular object of this invention to provide a turret punch machine tool which is capable of withdrawing workpieces from a stack of workpieces, performing a sequence of operations on the workpiece and depositing the completed workpiece in a stack of completed workpieces.

It is a more specific object of this invention to provide an automatic turret punch machine tool having a worktable with automatically controlled workpiece gripping members movable thereover to position any portion of a gripped workpiece with respect to the work station of the punch, the machine tool being provided with an automatic loading device capable of separating a workpiece from a storage stack of workpieces raising the workpiece to a table level, moving the workpiece to a position over the table, depositing the workpiece on the table in an area to be gripped by the workpiece gripping members and withdrawing from a position of possible interference with further operation of the machine tool, the machine tool being further equipped with automatically controlled devices for properly and adequately positioning the workpiece in the gripping members and setting reference points in the control for both X and Y axis of the gripping carriage at points corresponding to the position of the workpiece; the machine tool being further equipped with a mechanism for moving the completed workpiece to an unload area of the worktable, sensing deposit of a workpiece on the unload area of the worktable and withdrawing the gripping carriage from contact with the workpiece, and thereafter automatically unloading the completed workpiece from the worktable to a completed workpiece stacking device.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
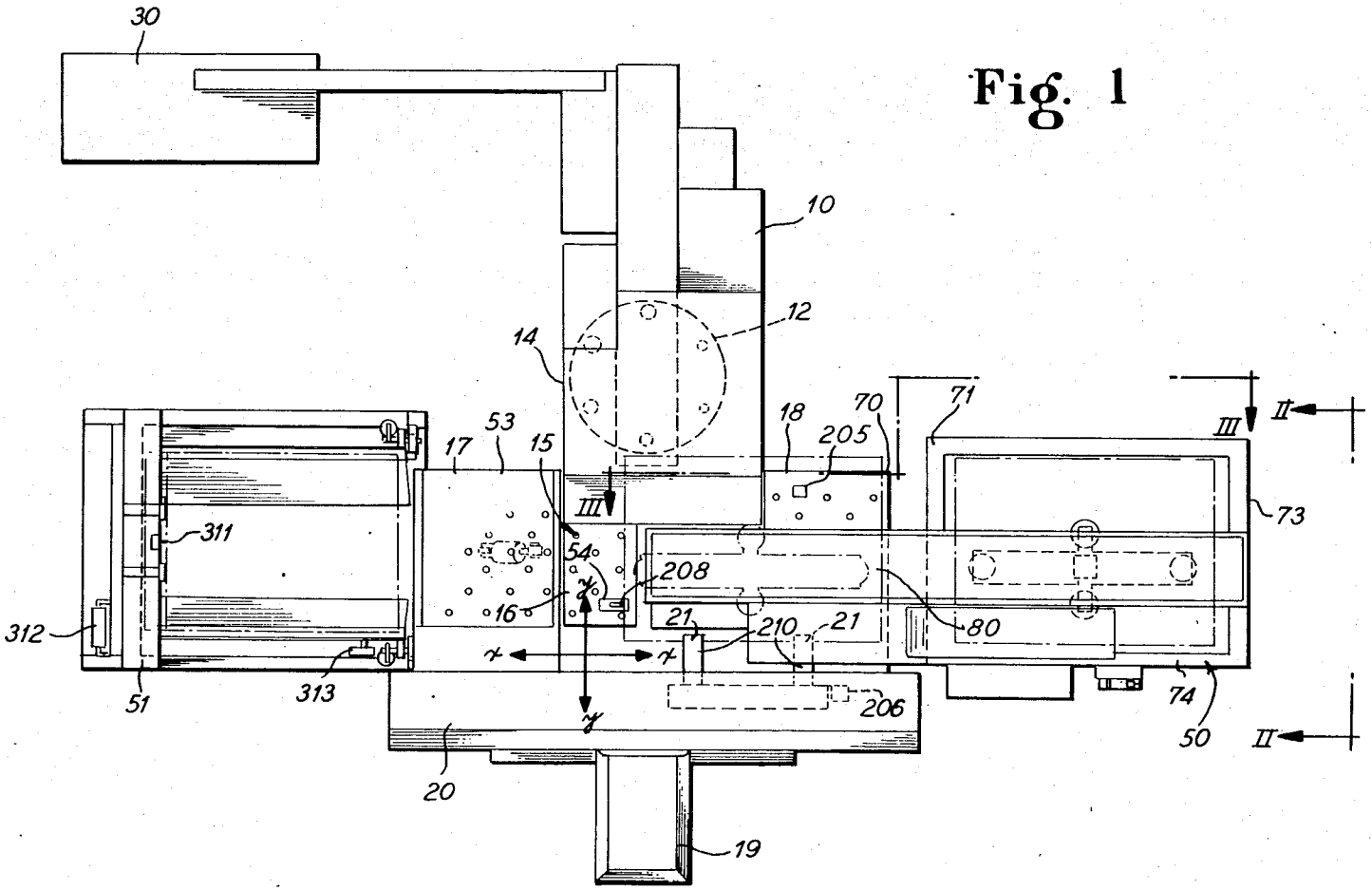
FIG. 1 is a top plan view of a turret punch machine tool equipped with the automatically controlled workpiece load, workpiece gauge and workpiece unload devices of this invention.
Figure 4:
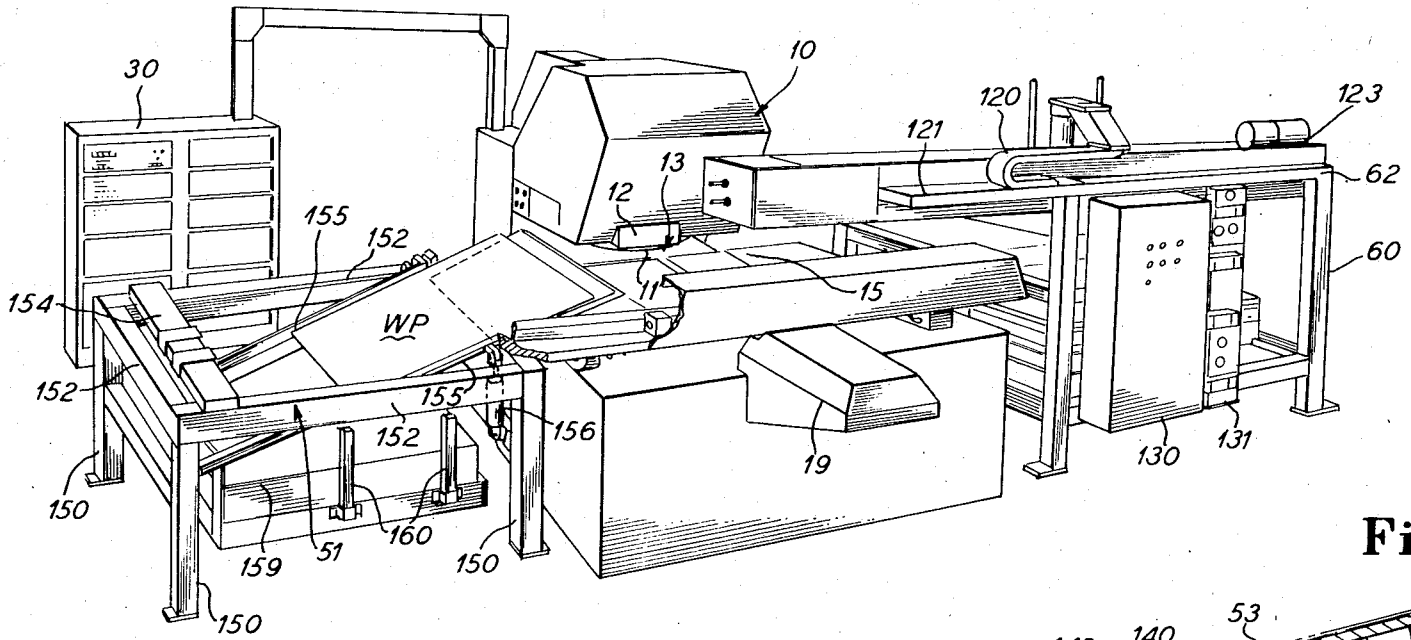
FIG. 4 is a perspective view of the assembly of FIG. 1.

As best illustrated in FIGS. 1 and 4, this invention is adapted for use in association with machine tools and more particularly with turret punches 10. Such turret punches comprise a punching station and include lower 11 and upper 12 spaced apart turrets containing respectively dies and punches with the turrets being rotatable to present any given set of punch and die at a work station 13. Positioned in front of the turret assembly housing 14 is an elevated worktable 15 which includes a stationary central portion 16 and in and out movable side portions 17 and 18. Movement of the side portions 17 and 18 is controlled by a motorized lead screw 19. A horizontally movable gripping carriage 20 is carried by the movable worktable portions 17 and 18 for movement therewith. The carriage 20 carries horizontally movable workpiece clamping means in the form of gripping members 21.

As is well known to the art, movement of the workpiece gripping members 21, the moving worktable portions 17 and 18 and the turrets 11 and 12 is controlled by a control means 30 which may be an NC, a punch tape reader, or a computer.

The particular control 30 to be utilized in association with this invention forms no part of the invention and standard available controllers may be utilized. For example an HC1000A control commercially available from Houdaille Electronics Division of Houdaille Industries, Inc. has proven to be usable in association with my invention requiring modification only to accept additional inhibit or command inputs and outputs. It is apparent that any person skilled in the art of designing machine tool controls will be able to provide control hardware and software to effectuate control of the devices as hereinafter described and therefore no attempt will be made to describe the construction of the control.

In the practice of this invention, an automatic workpiece loading device or magazine 50 is positioned adjacent one side of the worktable 15 and a workpiece stacking device or magazine 51 is positioned adjacent the other side of the worktable 15. The side of the table associated with the stacking device 51 is equipped with a tipping edge section 53 of the type described in the aforesaid application U.S. Pat. No. 4,080,855.

Additionally, the machine tool is provided with an automatic side gauge mechanism 54 of the type described in the aforesaid Ser. No. 720,803, the side gauge 54 including a switch 208. Further the gripping members 21 are provided with pressure sensing switches 210 and the carriage 20 is provided with an X axis gripping carriage position sensing switch 206 while the moving table portion 18 is provided with a Y axis position sensing switch 205 which may, for example, be actuated by a cam land on a base underlying the moving table portion. A sensing switch 207 is positioned adjacent the tip table section 53 and is effective to sense when the tip table is in a tipped condition. The addition of the tip table 53, the side gauge 54 and the sensing switches 205, 206, 207, 208 and 210 and the loading device, stacking device and control changes represent the only modifications from the state of the art turret punch machine tools necessary for the practice of this invention.

Figure 2:
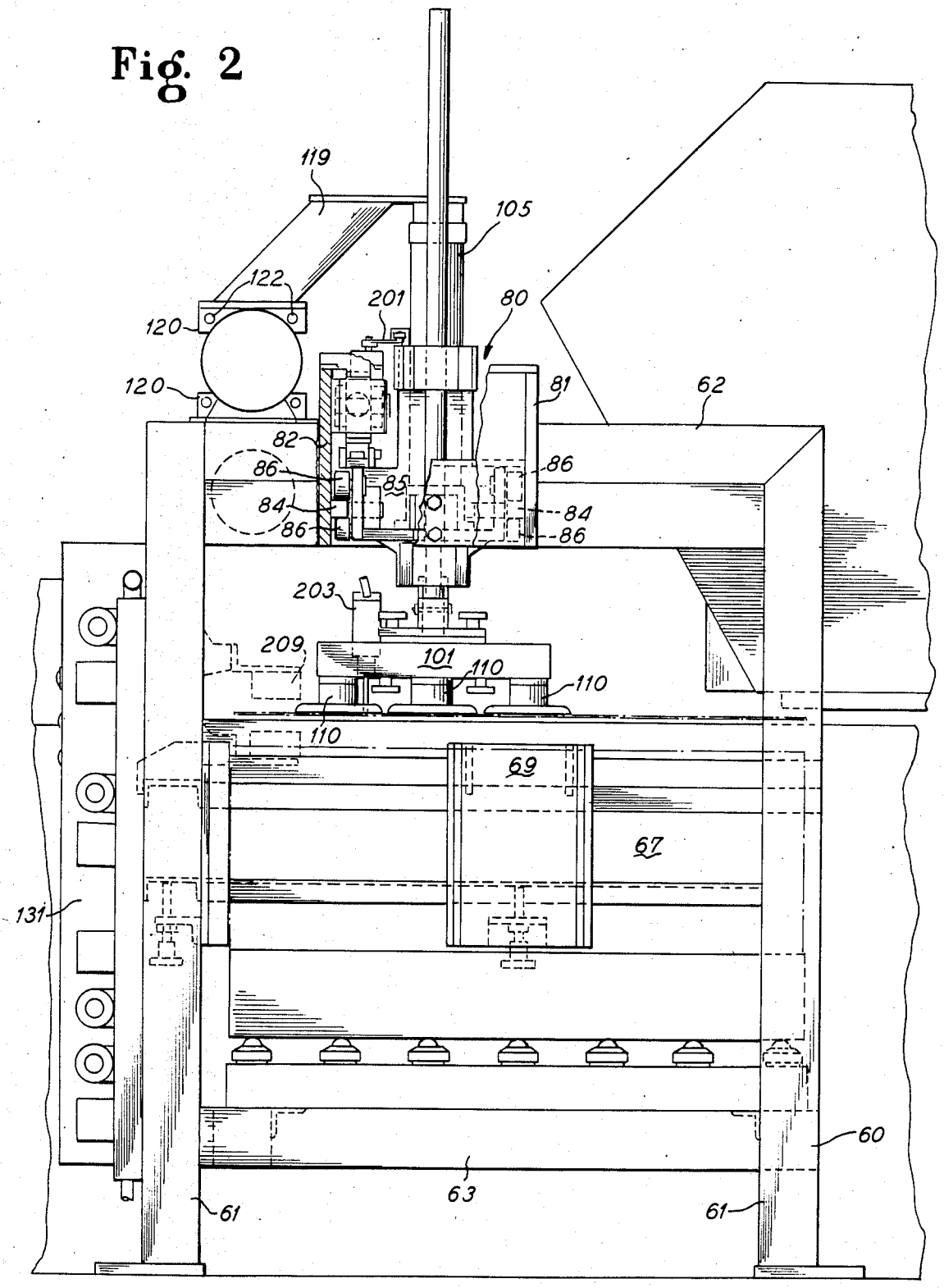
FIG. 2 is an end elevational view of the loading device taken along the lines II—II of FIG. 1.
Figure 3:
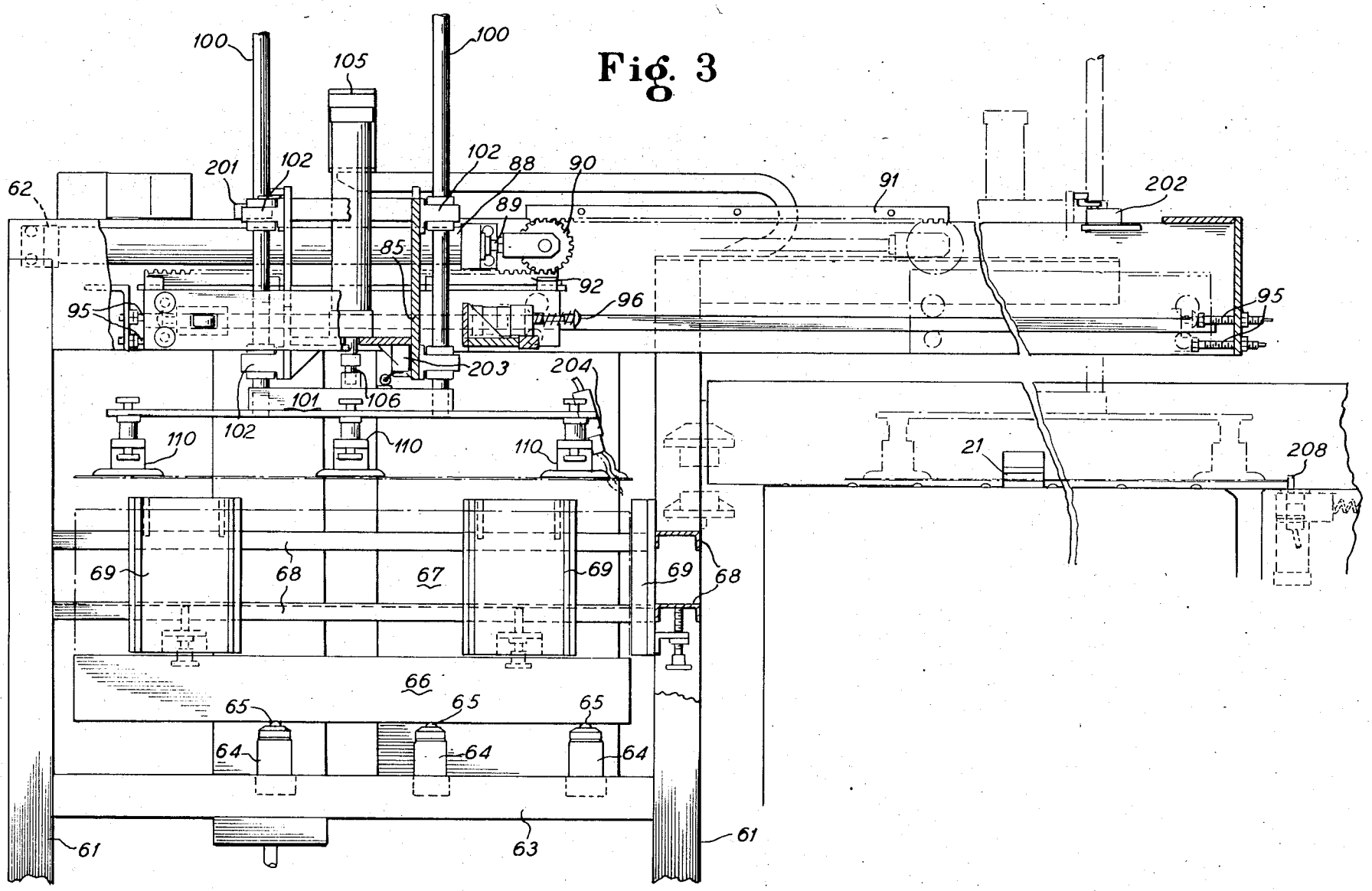
FIG. 3 is a back elevational view, partially in section, of the loading device taken along the lines III—III of FIG. 1.

As best shown in FIGS. 2 and 3 the workpiece loading device comprises a frame 60 including spaced uprights 61 capped by top rails 62 and supporting bottom rails 63. The bottom rails 63 are equipped with bed members 64 having anti-friction means 65 thereon for receipt of a pallet 66 containing a stack 67 of workpiece sheets. If desired a pad may be interposed between the anti-friction means 65 and the pallet 66 which will raise the pallet and thus adjust the volume of the loader magazine. Two sides of the frame enclosed area carry spaced parallel rails 68 on which are adjustably positioned sheet fanning magnets 69.

In order to provide adequate access to the corner 70 of the machine tool, the corner 71 of the frame has the side upright 60 extending only partway up. Thus the top rails 62 extend fully only on sides 73 and 74. Extending crosswise of the loader frame and cantilevering out over the table of the machine tool is a carriage track 80 including parallel walls 81 and 82 welded to the top rail 62 on the side 63 which, in turn, internally support inwardly projecting track pieces 84 on which a carriage 85 is mounted by means of rollers 86 such that the carriage is movable along the length of the carriage track from a position over the stack 67 to a position overlying approximately half the machine tool workpiece support table.

The carriage 85 is power moved by a double acting cylinder 88 having a power arm 89 terminating in a rotatable pinion 90. A fixed rack 91 carried by wall 82 overlies the pinion 90 and extends partway along the length of the carriage track 80. A moving rack 92 underlies the pinion 90 and is affixed to the carriage 85. Thus actuation of the cylinder 88 to extend the power arm 89 will cause movement of the carriage in the direction of movement of the power arm 89 with carriage 85 movement being twice power arm movement. Adjustable stops 95 at both ends of the tracks 84 cooperate with shock absorbers 96 affixed to the carriage 85 to limit movement of the carriage at the ends of the carriage track 80.

The carriage 85 has linear motion bushings 102 attached thereto through which parallel vertically disposed bushing rods 100 project. Rods 100 are affixed to a head member 101 positioned below the carriage and movable therewith. A double acting cylinder 105 carried by the carriage 85 has a power arm 106 attached to the head 101.

A plurality of pneumatic cups 110 are attached to and depend from the head 101 overlying the area of the stack 67 when the carriage is in the position illustrated in FIGS. 2 and 3. It will thus be apparent that the carriage 85 and the head member 101 comprise ejector means associated with the loader magazine for horizontally feeding workpieces one at a time in a feed direction from the loader magazine to the turret punch to be moved into operative association with the clamping means 21.

Hydraulic and electric power is supplied to the carriage 85 and head 101 through a channel 119 affixed to the cylinder 105 and movable therewith. The channel 119 is attached to a hairpin shaped self-laydown cat track 120 supported on a shelf 121 paralleling the carriage track 80. The cat track has electric and hydraulic conduits 122 extending therethrough, some of which are connected to a vacuum pump assembly 123 mounted atop the frame. A control panel 130 and a valve back panel 131, best illustrated in FIG. 4, are also mounted to the frame.

The unload device includes tip table section 53 hinged at 140 to the moving table portion support 141. A double acting valved cylinder 310 connected respectively to the support 141 and to the table portion 53 operates to selectively pivot the tip table 53 to an outside edge 142 down position such that a workpiece WP resting on the tip table 53 will be discharged to stacker 51. The stacker 51 is a four posted 150 frame having four cap rails 152 and a vertical height sufficient to position and remove a pallet from thereunder and which pallet may be of any selected size to adjust the volume of the unloader magazine for the desired dimensions of stack of punched workpiece sheets to be received thereon after released by the clamping means 21. Attached to the cap rails is a back wall and stop member 154 which is movable along the side cap rails towards and away from the machine tool worktable. Inclined angle rails 155 are affixed to the frame interior of the cap rails and at least one inclined rail 155 is adjustable towards and away from the other inclined rail. The inclined rails are preferably L-shaped rails and are mounted for longitudinal rotation with rotation being controlled by double acting cylinders 156 supported on the frame and having power arms 157 attached through a bracket 158 to the rotatable rails 159. The rails are initially spaced apart a distance equal to the width of the workpiece WP with slight clearance with one leg of the L shape turned inwardly towards the opposed rail forming a receipt land for the workpiece WP being discharged from the tip table 53.

Unload is accomplished by tipping the tip table 53 to slide the workpiece WP onto the inclined rails 155 which, due to the incline will allow the workpiece to continue its outward and downward movement away from the worktable 15 until it contacts the stop 154 which has been adjusted to a position dependent upon the length of the sheets being run. Thereafter the rails 155 are rotated inwardly to allow the sheet to drop to the pallet. The pallet may be equipped with vertical guides 160 to assist in guiding the sheet to the area of stacking on the pallet. Air resistance to the drop of the sheet aids in controlling the fall rate.

Operation of the loading device, the gauging and the unloading device and stacking member are all influenced by switches and controlled by valves under the direction of the control 30. The loading device is provided with a switch 201 for sensing positioning of the carriage over the stack 67 at one end of the carriage track 80 while a switch 202 senses positioning of the carriage over the machine tool support table at the other end of the carriage track 80. A switch 203 carried by the carriage 85 senses a raised positioning of the head 101 while a switch 204 carried by the head 101 senses engagement of the cups 110 with a workpiece.

Switch 205 senses positioning of the workpiece clamp carriage 20 at a position on the Y axis withdrawn away from the turrets 11 and 12 while switch 206 senses positioning of the clamps 21 at a position on the X axis withdrawn away from the tip table and adjacent the loader. Thus the Y axis positioning of the work clamps can be determined from switch 205 while the X axis positioning of the clamps can be determined from switch 206.

Figure 5:
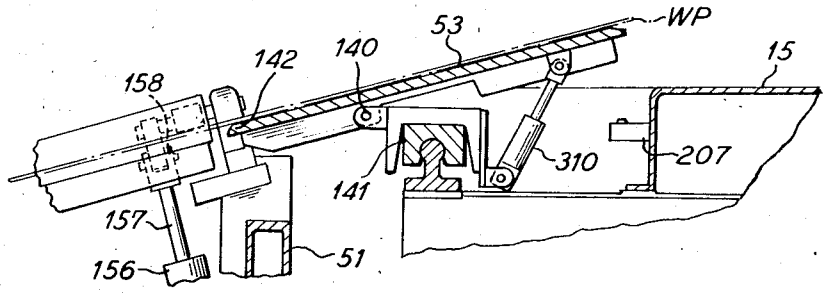
FIG. 5 is a fragmentary sectional view of the tip table section of the worktable and the workpiece receiving section of the stacking device.

Switch 207, best illustrated in FIG. 5, carried by the worktable 15, senses whether the tip table 53 is in an untipped condition. Switch 208 is activated when the side gauge 54 is contacted by a workpiece being moved by the clamps 21. Switch 209, illustrated in FIG. 2, carried by the loading device frame, comprises a transmitter-receiver double sheet sensing device indicating if the head 101 is transporting more than one sheet. Switches 210 are pressure sensitive switches carried by the workpiece gripping members 21 at a back of a throat opening of the members and detect the presence of a workpiece having an edge fully bottomed in the gripping members.

Figure 6:
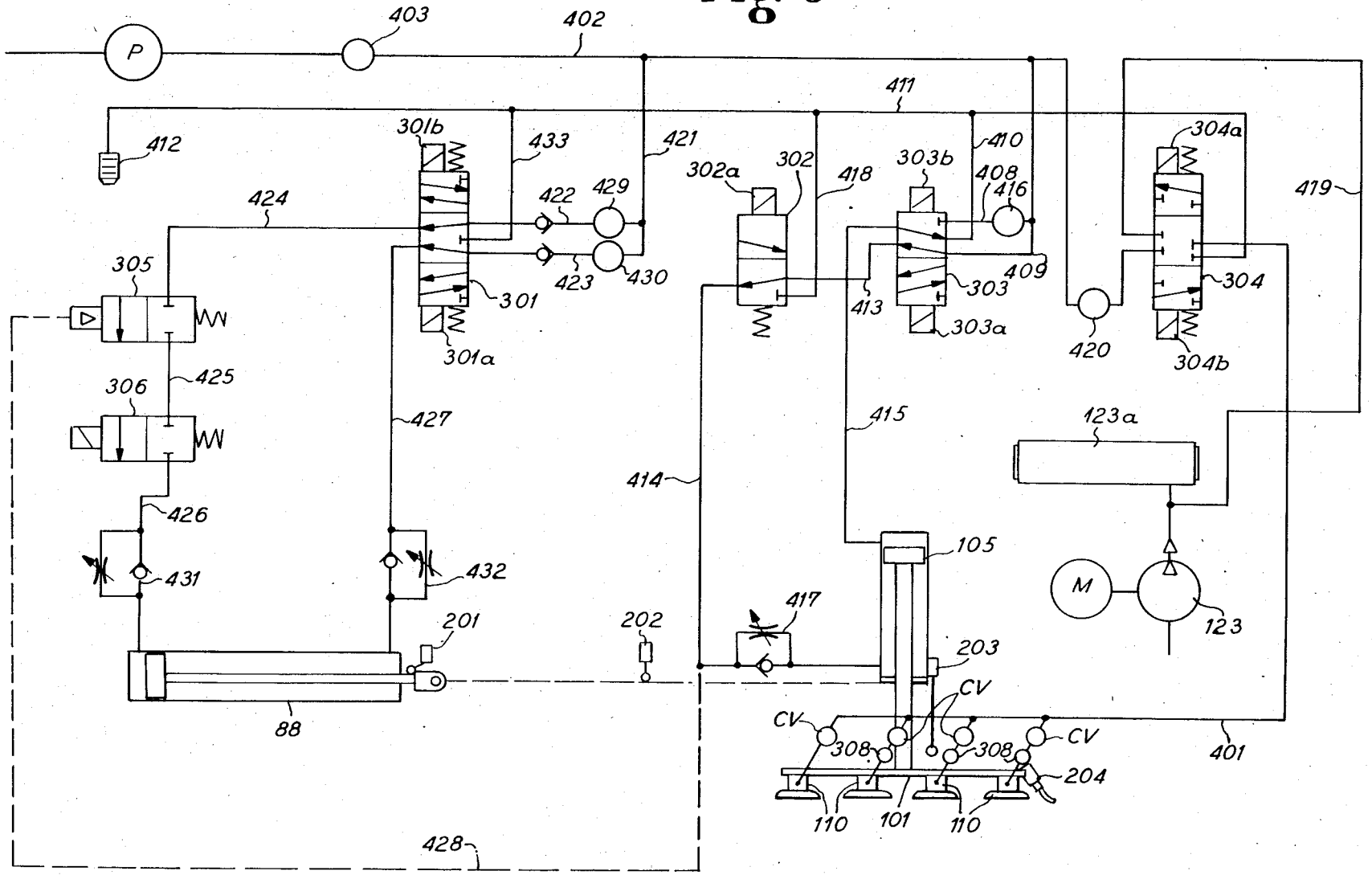
FIG. 6 is a diagrammatic flow chart of a hydraulic control system for the loader.

As best illustrated in FIG. 6, movement of the loading device carriage 85 and head 101 as well as activation of the cups 110 is controlled by solenoid activated valves 301, 302, 303 and 304 mounted on valve panel 131. Blocking valves 305 and 306 cooperate with valves 301 and 302 to prevent loader carriage movement at inappropriate times as is more fully hereinafter described.

Valves 308, in pneumatic line 401 to the cups 110 are individually actuatable to block or open line 401 to the individual cups allowing selective usage of the cups depending upon the size of the workpiece being loaded. Valve 309 carried by the carriage 20 activates the workpiece clamping members 21. Valve operated cylinder 310, illustrated in FIG. 5, operates the tip table while valves 311, 312 and 313 on the stacker 51 cooperate to control rotation of the rails 155.

OPERATION OF THE LOADING DEVICE HYDRAULIC CIRCUIT

As best illustrated in FIG. 6, hydraulic pressure is provided to the loading device 50 through line 402 from a factory air pressure source with pressure controlled by a regulator 403. Raising and lowering of head 101 through cylinder 105 is controlled by valves 302, and 303. Air pressure from line 402 is supplied by lines 408 and 409 to two position spool valve 303 while exhaust to atmosphere is provided by line 410 from spool valve 303 to line 411 open to the atmosphere through muffler 412. In the position of spool valve 303 illustrated, line 409 is communicated to line 413 which in turn communicates to two position spool valve 302 which opens line 413 to line 414 in communication with the bottom of cylinder 105. Thus with spool valves 302 and 303 in the position illustrated, head 101 will be raised and the top half of cylinder 105 will be exhausted through line 415 through spool valve 303 to line 410. Upon activation of solenoid 303*a* and deactivation of solenoid 303*b*, line 415 will be communicated to line 408 which, through pressure regulator 416, is in communication with pressure line 412 while exhaust line 410 will be communicated to line 413. In this position of valve 303, pressure will be supplied to the top of cylinder 105 while the bottom of cylinder 105 will be exhausted through line 414 through variable regulator 417 and therefore head 101 will descend.

By maintaining 303 in the position illustrated in FIG. 6 but activating solenoid 302*a* to shift the spool valve 302, the bottom of cylinder 105 can be vented to atmosphere through regulator 417, line 414 and line 418 to line 411 while pressure is not being provided to the top of cylinder 105. In this mode, head 101 descends by gravity against the resistance of regulator 417. This mode is used when head 101 is positioned over the worktable with a workpiece carried by cups 110 for deposit of the workpiece on the worktable. This allows gentle deposit of the workpiece on the table without forcing the workpiece to depress the spring loaded anti-friction rollers on the table to a point which would interfere with the ability of workpiece gripping members 210 to engage the workpiece.

Vacuum pump 123 operates through accumulator 123*a* to provide vacuum to line 419 to three position spool valve 304 which is in communication with exhaust line 411 and pneumatic line 401 as well as pressure line 402 through regulator 420. When solenoid 304*a* is operated to move spool valve 304 downward from the position illustrated, vacuum line 419 will be in communication with pneumatic line 401 providing suction to the cups 110. When solenoid 304*b* is operated to move spool valve 304 vertically up from the position illustrated in FIG. 6, pressure line 402 will be communicated to pneumatic line 401 to blow off a workpiece carried by cups 110.

Movement of the carriage 85 is controlled by a cylinder 88 which in turn is controlled by three position spring cnetered spool valve 301. When it is desired to advance the carriage, solenoid 301*a* is actuated communicating pressure line 402 through line 421 pressure regulator 429 and line 422 to line 424 which, in turn, connects through pilot valves 305 and 306 and lines 425 and 426 and variable regulator 431 to provide pressure to the left hand side of cylinder 88 in the view shown in FIG. 6 to advance carriage 85 towards the worktable. At the same time, line 427 in communication with the right hand side of cylinder 88 through variable resistance 432 is communicated to line 433 to exhaust line 411. Pilot valve 305 is operated as a spring biased closed valve openable only when pressure exists in line 414 indicating the head 101 is in a raised position. This prevents movement of the carriage when such movement could damage head 101. Pilot valve 306 is a normally closed solenoid activated valve which is advanced to an open position by the controller 30. During normal operating conditions pilot 306 is maintained in an open condition during all normal operating conditions, however, it will be unpowered and therefore spring closed any-time an emergency stop or all hold signal is given to the controller 30 or whenever electric power is lost within the system.

When spool 301 is in the centered position illustrated in FIG. 6 and pilots 305 and 306 are open, cylinder 88 will be maintained in a hold condition so long as regulators 429 and 430 are balanced to compensate for the difference in surface area on opposed sides of the piston of cylinder 88.

When it is desired to retract head 101 to a position over the stack 67, solenoid 301*b* activated to communicate line 427 to line 423 through regulator 430 to line 421 to pressure line 402. At the same time, line 424 is communicated to line 433 to exhaust line 411 thereby exhausting the left hand side of cylinder 88.

STEP BY STEP OPERATION OF INVENTION

Figure 7:
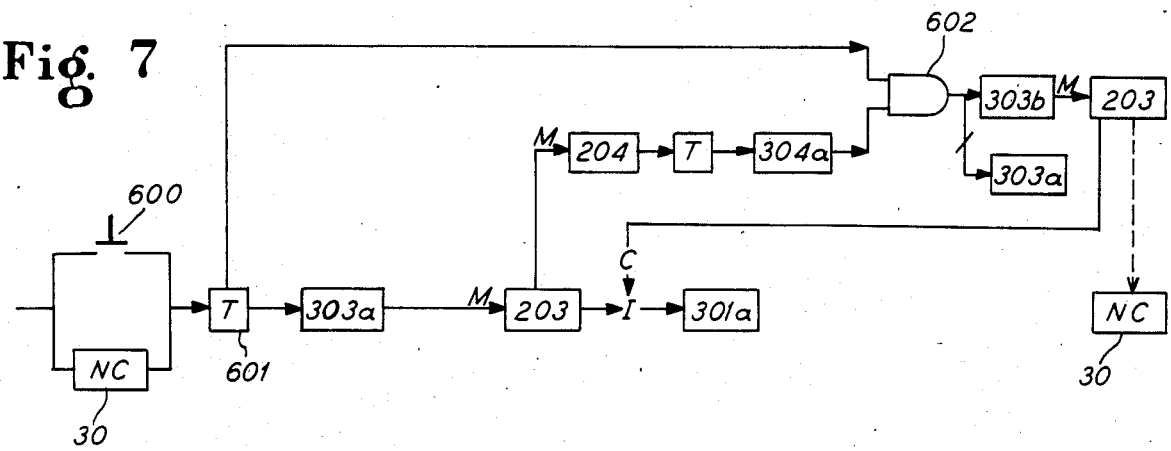
FIG. 7 is a diagrammatic flow chart of a first operating phase of the loading device.
Figure 8:
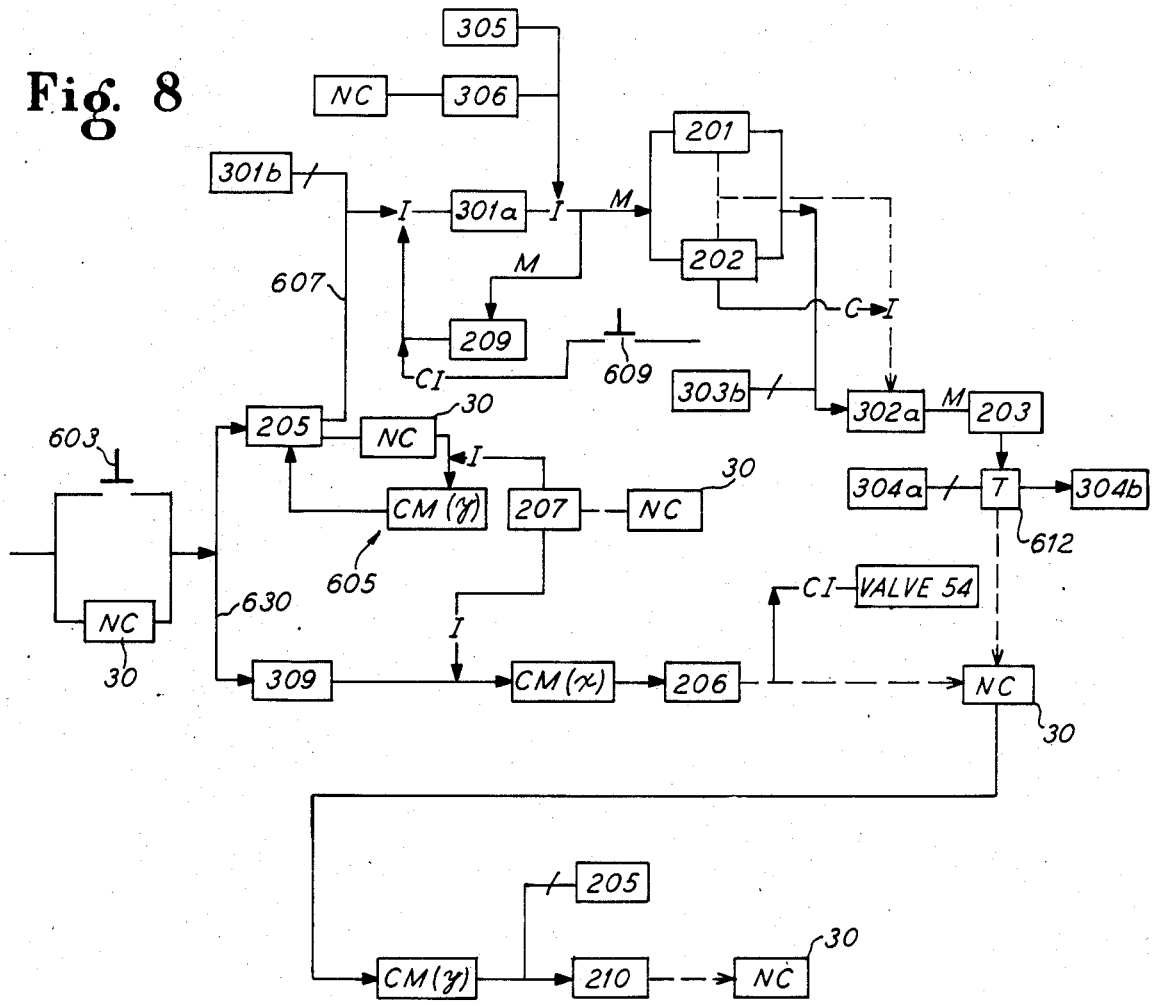
FIG. 8 is a view similar to FIG. 7 illustrating a second operating phase of the loading device and a first gauging phase.
Figure 9:
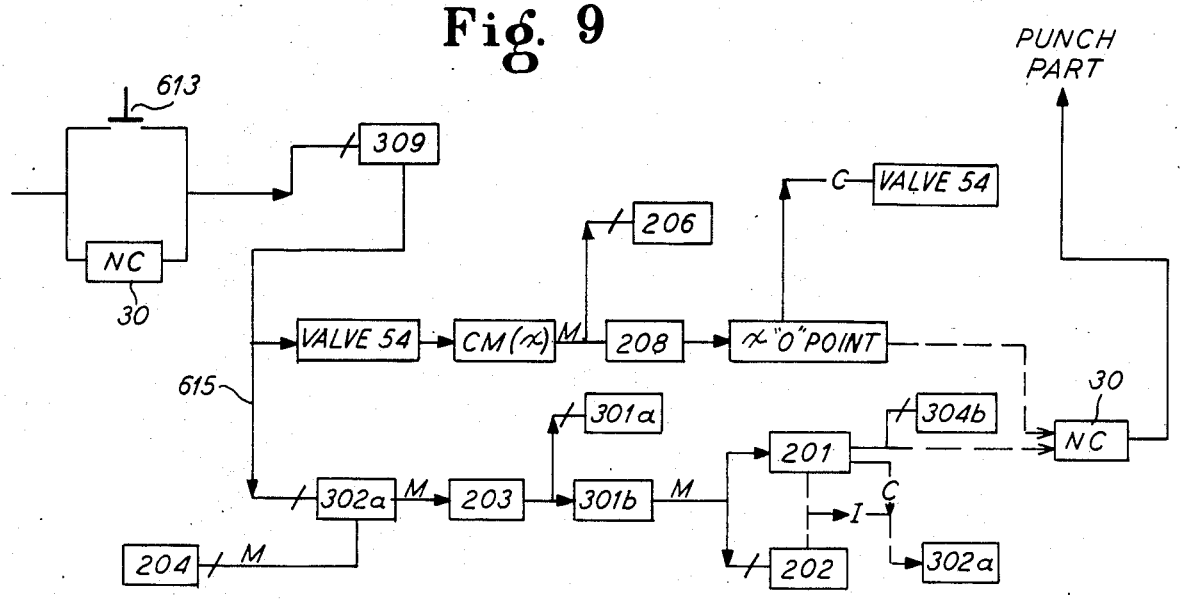
FIG. 9 is a view similar to FIG. 8 illustrating a third operating phase of the loading device and a second gauging phase.

FIGS. 7 through 10 diagrammatically illustrate the automatic operation of the loading device, workpiece gauging and the unloading device of this invention under control of controller 30. FIG. 7 illustrates the descent of head 101, the attachment of a workpiece from stack 67, and the ascent of head 101 of loading device 50. FIG. 8 continues operation of the loading device from FIG. 7 and illustrates advance of carriage 85 to position head 101 over the machine tool worktable positioning of the workpiece gripping members to a machine tool load position, descent of the head 101 to deposit the workpiece on the worktable and the gauging of the workpiece in the Y axis. FIG. 9 illustrates a further sequencing of the loading device from FIG. 8 to withdraw head 101 from the machine tool worktable and from contact with the workpiece, to withdraw carriage 85 to a position over stack 67 and to gauge the workpiece in the X axis direction.

Figure 10:
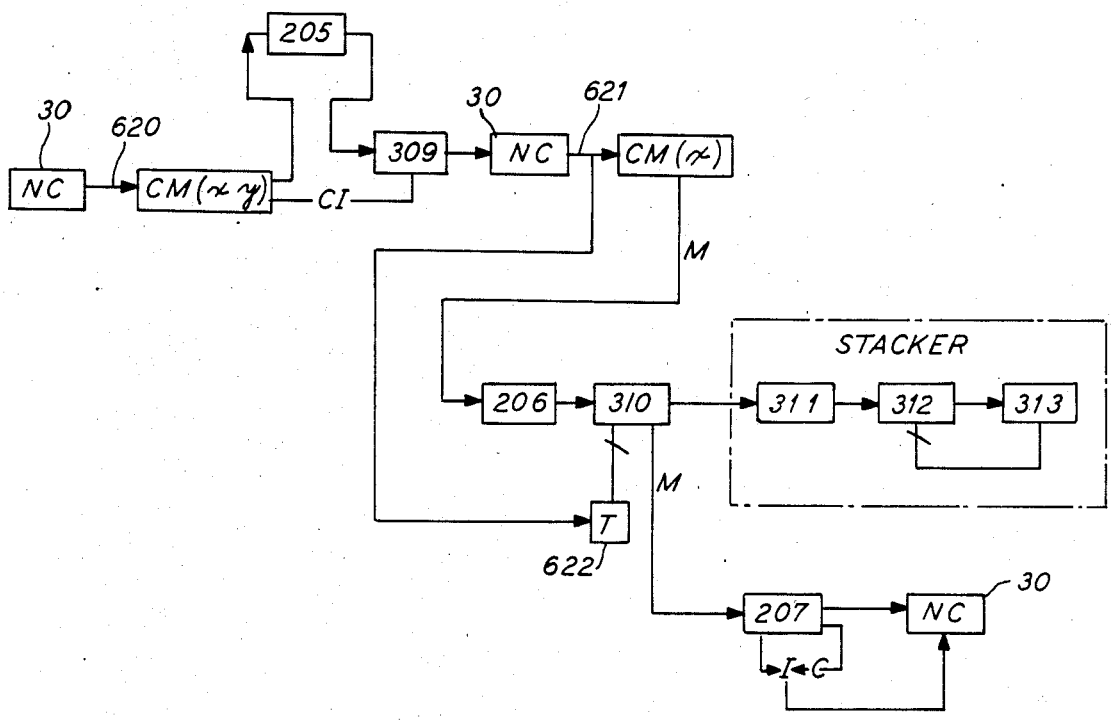
FIG. 10 is a view similar to FIGS. 7 through 9 illustrating an unloading phase.

FIG. 10 illustrates the unloading sequence.

In FIGS. 7 through 10, NC indicates the controller 30, T indicates a time delay clock, M indicates that the effect on the next illustrated device is caused by movement of a device rather than by a signal input. I indicates an inhibit signal preventing actuation of a device, C indicates a cancel signal cancelling an inhibit signal. A (/) mark through a line indicates a signal to return a device to a previous state of activation, (CM) indicates gripper carriage movement in either or both the X and Y directions as indicated.

Operation of the loading device, the gauging devices and the unloading device sequencing takes place in at least four distinct steps. The first step is a loading device ready step during which the loading device head descends over the stack 67, engages the top sheet of the stack and raises it to a carriage transport position. This step is independent of any operation being carried out in connection with the machine tool and can be programmed to run simultaneously with a piece program of the machine tool.

A second step involves transport of the loaded workpiece to a position above the machine tool worktable, movement of the workpiece gripping members to a load position, descent of the head to deposit the workpiece on the worktable, partial disengagement of the workpiece from the head, and workpiece gauging in the Y axis. A third step clamps the workpiece in the workpiece gripping members, withdraws the head to a transport position above the table, withdraws the loading device carriage to a position above the stack 67, moves the workpiece in the X axis direction and gauges it and terminates the load sequence. The fourth step moves the completed workpiece to the unload station of the worktable, disengages the workpiece from the workpiece gripping members, withdraws the workpiece gripping carriage from the tip table section of the worktable, removes the workpiece from the machine tool worktable and deposits it in the stacking device and cycles the stacking device to stack the workpiece in a finished product stack.

The sequence of operations involved in the first step is illustrated in FIG. 7 where the cycle is activated by a signal either generated in the manual mode from a push button 600, or in the automatic mode from the controller 30. The signal is fed to a timing clodk 601 and directly from that to valve solenoid 303*a*. Actuation of valve solenoid 303*a* places pressure line 408 in communication with line 415 while venting line 413 to line 410. This causes the loader head 101 to descend into engagement wih stack 67. During descent, switch 203 opens providing an inhibit signal preventing actuation of solenoid 301*a* which prevents movement of carriage cylinder 88 to move the carriage 85 away from the the overstack position. Descent of the head brings switch 204 into contact with the top sheet of the stack 67 which after a time delay to assure proper seating of the cups 110 on the top sheet of the stack sends a signal to activate solenoid 304*a* which communicates vacuum line 419 to line 401 supplying vacuum to the cups 110. Activation of solenoid 304*a* provides a signal to an and gate 602 which also receives a signal from timer 601 and in the presence of both signals provides a signal to activate solenoid 303*b* while at the same time deactiating solenoid 303*a*. This communicates pressure line 409 to line 413 and through valve 302 to line 414 while at the same time venting line 415 to line 410. In this valve position, head 101 is lifted from engagement with the stack 67 to a transport position above stack 67 thereby closing switch 203. Closure of switch 203 cancels the inhibit on valve solenoid 301*a* and provides a signal to the controller 30 indicating that the loader is now in the loading device ready condition.

FIG. 8 illustrates the second step which is initiated either by a signal from controller 30, or, in the manual mode, from push button 603. Because operation of step 2 will bring the loading device into the area of the machine tool, the signal from controller 30 or from button 603 is prevented from activating the loading device unless certain machine tool table conditions exist. First, as indicated, at 605, the workpiece gripping carriage must be properly positioned in the Y axis direction with switch 205 closed. Movement of the Y direction is under the influence of the controller 30 and was previously accomplished in connection with the unloading cycle prior to actuation of tip table 17. Actuation of tip table 17 had opened switch 207 under control of the controller 30 which had placed an inhibit on further movement of the carriage in either the X or Y axis. If, upon receipt of signal from the button 603 or controller 30, switch 205 does not indicate the proper positioning of the workpiece carriage in the Y axis direction, the controller 30 will cause movement to the proper position unless inhibited by switch 207. Upon closure of switch 205 indicating proper positioning of the workpiece gripping carriage in the Y axis, the signal 607 will cancel activation of solenoid 301*b*, if that solenoid remains actuated from a previous cycling of the loader. At the same time signal 607 will actuate solenoid 301*a* which will cause an initial movement of the cylinder 88 by communicating pressure line 422 with line 424 while venting 427 to line 433. Pressure in line 424 will provide pressure in line 426 unless blocked by pilot valves 305 or 306. Thus, as indicated, valves 305 or 306 can inhibit any movement of cylinder 88 even though solenoid 301*a* is activated. Valve 305 senses head lifting pressure in the bottom of cylinder 105, which, if present indicates that head 101 is raised. Sensing is through pilot line 428. If the head 101 is raised, valve 305 communicates line 424 to line 425. Valve 306 is solenoid operated by controller 30 and will communicate 425 to line 426 unless the controller is in an emergency stop or all hold condition or electric power has failed to the system. In the absence of an inhibit from valves 305 or 306, movement of cylinder 88 will begin to move carriage 85 towards the machine tool. This movement will pass the workpiece suspended from the cups 110 between the double sheet transmitter receiver sensor 209. If a double sheet is detected, an inhibit signal will be sent to terminate the signal to 301*a* and initiate an all hold condition. The inhibit can be cancelled by manual push button 609 upon correction of the double sheet condition. In the absence of an inhibit from switch 209, movement of the carriage 85 deactivates switch 102 producing an in phase condition between switches 201 and 202 during movement of the carriage 85. This in phase condition produces an inhibit on further actuation of solenoid 302*a* preventing inappropriate lowering of head 101. Upon completion of travel of carriage 85, switch 202 is activated eliminating the in phase condition between switches 201 and 202 and providing a cancel to the inhibit of valve 302*a*. Activation of switches 201 and 202 to the proper out-of-phase condition produces a signal to cancel activation of solenoid 303*b* and to activate solenoid 302*a*. Activation of solenoid 302*a* vents line 414 to line 418. At the same time line 415 has previously been vented to line 410 so there is now no pressure being provided to cylinder 105. Therefore head 101 will drop to the machine tool work support table under gravity while forcing any air out of the bottom half of pressure cylinder 105 through restricted orifice 417. This gravity drop feature is desired in that it insures that no force, other than the weight of the head 101, is applied pushing the workpiece against the machine tool workpiece support table. If excess pressure were applied, the workpiece would bottom the anti-friction balls on the machine tool workpiece support table and bring the workpiece to a position below which it would be grabable by the workpiece gripping members. Descent of the head 101 opens switch 203 which provides a signal to timer 612. This timer provides a delay sufficient to allow the workpiece to be deposited on the machine tool workpiece support table and then sends a signal to cancel activation of solenoid 304*a* terminating vacuum supply to the cups 101. Simultaneously a signal is sent activating solenoid 304*b* communicating pressure line 402 through regulator 420 to line 401. This blows air through cups 110 to break suction contact between the cups and the deposited workpiece. While the carriage 85 has been moved from the loader stack area to a position over the workpiece support table, the signal from manual button 603 or the NC 30 which activated that movement has simultaneously provided a signal to valve 309 causing the workpiece gripping members to open and causing workpiece gripping carriage 20 movement in the X axis direction, unless inhibited by 207, to bring the workpiece gripping members to a load position in the X axis direction, at which time switch 206 is closed to provide a signal to the controller 30 indicating that the workpiece gripping members 21 are in the proper position in the X axis direction for receipt of the workpiece being loaded. Proper positioning in the Y axis direction had been previously assured by passage of the signal to initiate movement of the loading device from the ready position through switch 205. The same signal advising the controller 30 that the workpiece gripping members are in the proper position in the X axis direction can be utilized to clear any inhibit on actuation of the valve for side gauge sensor 54.

Upon receipt of signals from timer 612 and switch 206, controller 30 initiates movement of the workpiece gripping carriage in the Y axis direction. Since the carriage had previously been moved to a designated 0 point at the workpiece gripping carriage load position, and since that point is known with the controller, movement in the Y direction is restricted to a pre-set distance, for example 1.5 inches. During this movement, the open gripping members 21 will move into position around the deposited workpiece until the edge of the workpiece contacts sensors 210 located at the back of the workpiece gripping member throats. During this movement, the workpiece, resting on the machine tool worktable will still have the weight of head 101 resting thereon which provides a sufficient resistance to movement of the workpiece on the worktable to prevent the engagement of the workpiece by the gripping members from imparting sufficient movement to the workpiece to cause it to jump away from the workpiece gripping members. At the same time, due to the flexibility of cups 110, movement of the workpiece by contact with the moving workpiece gripping members is allowed so that the workpiece can pivot with respect to the machine tool worktable and to head 101. This pivoting allows the straight edge of the workpiece to engage each of the workpiece gripping members 21 even though the loader may have deposited the workpiece on the machine tool worktable in a canted condition out of parallelism with the workpiece gripping members 21. It has been empirically determined that a movement in the Y axis direction of 1.5 inches is sufficient to insure activation of sensors 210 in each of the workpiece clamping members 21, when the clamping members 21 are of a normal size and when the workpiece has been moved and deposited on the worktable in the generally designated area and generally properly aligned into operative association with the clamping means members 21. However, since alignment of the workpiece on the worktable is, according to this invention, not a critical function of the loader, and since alignment can vary depending upon the positioning of the stack in the loading device and oscillations of the workpiece allowed by the flexibility of the cups 110, other embodiments may require a greater movement in the Y axis. A desired feature of this invention is the fact that proper alignment of the workpiece in the Y axis direction is accomplished by movement of the gripping members against the deposited workpiece on the machine tool worktable and sensing of proper contact between the workpiece and the gripping members 21 by switches 210 which may be pressure switches. Thus, I have eliminated any major criticality relating to the deposit of the workpiece on the workpiece support table while at the same time avoiding the necessity of any complex sideways movements of the loading mechanism to bring the workpiece into the clamping members. Since the distance of movement of the clamping members 21 from the base line to the point of full engagement with the workpiece is known, upon closure of the switches 210 and completion of the movement of the workpiece gripping members in the Y axis direction, the exact positioning of the forward edge of the workpiece with respect to the machine tool center line is known by the controller, since the controller knows that the then positioning of the workpiece grippers in the Y axis direction is 1.5 inches inward from the Y axis zero point. Closure of switches 210 sends a signal to controller 30 indicating that the workpiece has been properly gauged, or positioned in the Y axis direction thereby terminating step 2.

FIG. 9 illustrates step three which once again is initiated by a signal from controller 30 or, in the manual mode from push button 613. That signal cancels activation of solenoid 309 causing the workpiece gripping members 21 to close into engagement with the properly Y axis positioned workpiece. Upon closure of the workpiece gripping members 21, the signal may be used to activate the valve on side gauge sensor 54 to project the sensor above the surface of the workpiece support table. The signal also deactivates solenoid 302*a* which, because valve 302 is a spring biased valve, communicates pressure line 413 with line 414. This raises cylinder 105 to lift head 101 to a transport position above the machine tool worktable. Movement of the head causes switch 204 to rise out of contact with the workpiece thereby indicating that cups 110 are free of the workpiece. Further movement closes switch 203 which produces a signal cancelling activation of solenoid 301*a* and activating solenoid 301*b*. Activation of solenoid 301*b* communicates pressure line 423 with line 427 and vents line 431 through lines 426, 425 and 424 to line 433. This causes retraction of cylinder 88 moving carriage 85 from the position over the machine tool worktable to the position over the loading device stack 67. During this movement switch 202 is initially opened causing an in phase condition between 202 and 201 producing an inhibit on activation of solenoid 302*a* and, if desired, 303*a* preventing downward movement of head 101. Upon completion of movement of cylinder 88, switch 201 is contacted eliminating the in phase condition and cancelling the inhibit. Closure of switch 201 provides a signal which may be used to cancel the signal to 304*b* turning off the blow off air and sending a signal informing the controller that the loading device is clear of the machine tool. The valve for side gauge sensor 54 has been activated to raise the side gauge sensor above the workpiece support table 15. The workpiece gripping member carriage 20 is now caused to move in the X axis direction by signal 615. Since the gripping members 21 are closed, the workpiece will be carried in the X axis direction until its leading edge abuts side gauge 54. This abutment of side gauge 54 will cause movement of the side gauge projection, which movement closes switch 208 at a point precisely positioned with respect to the machine tool center line. This precise positioning of the point at which switch 208 is closed during lateral movement of the projecting portion of side gauge 54 allows switch 208 to send a signal to the controller setting the X axis at zero point at the position of the workpiece gripping carriage 20 at that instant. This precisely gauges or positions the workpiece in the X axis irrespective of what point along the X axis length of the workpiece it was gripped by the workpiece gripping members 21. Since the position of switch 208 is known with respect to the machine tool center line, and since the position of the workpiece gripping members at the point of closure of switch 208 is known within the controller, the workpiece has now been precisely gauged in both the X and Y directions. This gauging can be used to send a signal to cancel actuation of the valve for the side gauge projection 54 withdrawing the side gauge to a position below the workpiece support table and allowing free movement of the workpiece over the support table. At the same time a signal is sent to the controller 30 for comparison with the signal from 201. The presence of both signals indicates that step 3 has been completed and the controller can be cycled to its next command initiating the piece program on the workpiece.

Upon completion of step 3, the loading device is once again repositioned over the loader stack 67 and all valves and switches are in the position illustrated in FIG. 6 except that solenoid 301*b* remains activated maintaining the cylinder 88 in the over-stack position. Because of the balanced pressure condition of the spring center point of valve 301, solenoid 301*b* mauy be deactivated if desired as a final step of cycle 3 from a signal from switch 201. However deactivation is not required since signal 607 of FIG. 8 accomplishes that result.

Upon completion of the piece program, the unloading cycle, step 4, is triggered by the controller 30 as being the next command within the controller upon completion of production run sequence. This command causes a set of signals 620, illustrated in FIG. 10, to be sent to the controls for movement of the workpiece gripping carriage to move the workpiece gripping carriage in both the X and Y axes to a position where the workpiece is positioned over the tip table portion 17. Arrival at this position is sensed by Y position sense switch 205. At the same time, the command which caused the carriage to be moved to the unload position clears any inhibit upon actuation of valve 309 which inhibit has been present throughout the piece program in order to maintain the workpiece in the workpiece gripping members.

Actuation of switch 205 provides a signal to activate valve 309 to open the workpiece gripping members 21. Control 30 is then signaled that the gripping members are open and controller 30 initiates a signal 621 which causes movement of the workpiece gripping carriage in the X axis direction away from the tip table 17 and back to the load position thereby closing switch 206. Closure of switch 206 activates the valve operated tip table cylinder 310 to tip the table segment 17. It can therefore be seen that in order to tip table segment 17 both switches 205 and 206 must be activated to insure that the workpiece is clear of any overhanging portions of the machine tool. The same signal 621 which causes movement of the workpiece gripping carriage in the X axis provides an input to time delay clock 622 which, after a delay, sends a signal to cancel activation of valve operated tip table cylinder 310 thus closing the tip table segment 17.

Activation of valve operated tip table cylinder 310 had opened switch 207 thereby providing an inhibit to the controller 30 preventing any further commands from being issued by the controller 30 during operation of the tip table. Closure of the tip table caused by the signal from time delay clock 622 closes switch 207 cancelling the inhibit on controller 30 and at the same time sending a signal to the controller 30 which may be used to instruct the controller to advance to its next command.

Activation of the tip table 17 causes the workpiece to slide thereoff, as indicated in FIG. 5. Movement of the workpiece is onto the inturned legs of the L-shaped rotatable rails 155. Further movement of the workpiece on the inclined rails 155 brings the leading edge of the workpiece into contact with end wall 154. End wall 154 is equipped with pilot valve 311 which is closed by engagement with the leading edge of the workpiece. Closure of valve 311 operates master valve 312 to open valve 313. Valve 313 activates cylinders 156 to cause rotation of rails 155. Rotation of the rails drops the completed workpiece onto the completed workpiece stack 159 positioned under the unload stacking device 51.

Dropping of the workpiece from the rails 155 disengages contact with valve 311 which terminates signal to valve 312 which in turn terminates the signal to the valves 313 causing cylinders 156 to return to the unrotated position of the rails 155.

It can be seen that the unload stacking device 51 is totally independent of the controller 30 and further, is completely hydraulically or pneumatically operated. These are felt to be desirable advantages in that they reduce the complexity of the control function while at the same time avoiding dual power supply to unload stacking device 51.

It will further be noted that upon the completion of step 4 the workpiece gripping carriage has been moved to the load position on the worktable with switches 205 and 206 closed. It will be appreciated that this effects the actual sequence of step 2 as shown in FIG. 8 in that switch 205 is closed as well as switch 206. Thus the initial signal in step 2 is in normal circumstances, the signal 607 and that portion of signal 630 which activates valve 309 to open the clamps and provide a signal to control 30, and if desired to clear the inhibit to operation of the valve of side gauge sensor 54. Further, it can be seen that the activation of tip table valve 310 in step 4 is the source of the inhibit from switch 207 indicated in FIG. 8. That portion of FIG. 8 included within the dot-dash lines constitutes a duplication circuit to portions of FIG. 10 allowing step 2 to be operated without prior operation of step 4.

It will be further appreciated that although FIGS. 7 through 10 illustrate, diagrammatically, certain sequences of happenings within the operation of the load, workpiece positioning, and unload cycles of this invention, that other sequences of steps can be utilized, and further, that other and separate signals may be utilized. For example, separate operating circuits within the controller 30 can be provided whenever a point has been reached that the next successive point is under bar by an inhibit. These operating circuits can be used to automatically back check and clear the inhibit condition. Additionally, other inhibits may be provided, if desired. For example, an inhibit to activation of the machine tool turrent and punch ram may be provided during any of cycles 2, 3 and 4. Additionally other sensors may be provided, for example a sensor indicating exhaustion of stack 67 or overfill of the unload stacking device 51.

Thus, the sequences described are only illustrative of a presently preferred embodiment. It is contemplated that other methods of controlling the combinations of a machine tool with an automatic loading device, automatic initial workpiece positioning on the tool worktable and an automatic unloading device will be utilizable to those skilled in the art.

It will therefore be seen from the above that I have provided an automatic machine tool which, under common control automatically: loads a workpiece onto the machine tool worktable from a stack of workpieces, positions the loaded workpiece accurately with respect to the machine tool, gauging it in both X and Y axes, by means other than highly precise movement by the loading device, production runs the workpiece through the machine tool, and unloads the workpiece from the machine tool worktable to a finished workpiece stack.

Although the teachings of my invention have herein been discussed with reference to specific theories and embodiments, it is to be understood that these are by way of illustration only and that others may wish to utilize my invention in different designs or applications.

I claim as my invention:

1. A machine tool device comprising, in combination: an automatic control device, a machine tool, a worktable adjacent the machine tool, a workpiece loading device adjacent the worktable having carriage means for moving a workpiece from a supply spaced from the worktable to a loading portion of the worktable and depositing it thereon, a workpiece grasping and moving device associated with the worktable for moving a workpiece on the worktable, means for gauging a workpiece deposited on the loading portion including sensing means sensing engagement of the deposited workpiece with devices having positions on the worktable which is known by the control device at the time of gauging, at least one of said devices being movable under control of said controller to a known position, said means for gauging including moving means causing relative movement between the workpiece and the sensing means to cause said engagement, actuation of the sensing means providing an input to the automatic control device indicating positioning of portions of the workpiece at the known positions, the machine tool, loading device, workpiece grasping and moving device and moving means all being under the control of the control device.

2. The device of claim 1 including unloading means associated with the device for removing a completed workpiece from an unload area of the worktable, the unload device being under control of the control device.

3. A machine tool device comprising in combination, a machine tool, a worktable adjacent the machine tool, a workpiece loading device having means for moving a workpiece from a workpiece supply spaced from the worktable, gauging means for automatically positioning a workpiece placed on the worktable by the loading device with respect to the worktable and the machine tool in X and Y axis directions, said gauging means including spaced apart sensors for indicating to a controller the positioning of the workpiece in each of the axis directions, a workpiece gripping and moving device for moving the gauged workpiece in both X and Y axis directions on the worktable relative to the machine tool, an unload device for unloading a workpiece from the worktable, the machine tool, loading device, gauging means, workpiece grasping and moving device and unload device being all under automatic control from the control device whereby the machine tool device is capable of sequentially operating upon a plurality of workpieces without human intervention.

4. A turrent punch machine equipped with a plurality of tools selectively actuatable to work on a workpiece at a machine work station, the machine comprising, in combination, a workpiece support table, a workpiece clamping carriage movable in X and Y axes directions with respect to the work station under the control of an automatic controller, the controller controlling selection and actuation of the tools, an automatic loading device effective to load one workpiece from a stack of workpieces adjacent a side of the table onto a portion of the table under the control of the controller, first control means associated with the controller for causing the workpiece clamps on the carriage to clamp the loaded workpiece when the loaded workpiece has an edge to be clamped in a predetermined position on the support table in a first of the X and Y axes directions, the predetermined position being established in the controller, second control means for automatic side gauging of the position of the loaded workpiece, said second control means including a workpiece position sensing device operatively connected to the controller effective to determine positioning of the workpiece on the support table in a second of the X and Y axes directions by contact between the sensing device and an edge of the workpiece, said first and second control means operating sequentially, and an automatic unloading sequence effective to unclamp the workpiece from the carriage at a predetermined position on the table and third means to unload the workpiece from the table at a side of the table under the control of the controller whereby loading, clamping, gauging, workpiece moving with respect to the work station, tool selection and activation, unclamping and unloading are all automatically controlled.

5. In a machine tool turret punch having tool carrying turrets rotatable under command from a machine tool associated automatic control to present selected sets of tools at a work station of the machine tool, a worktable adjacent the work station, a workpiece movement device including workpiece engaging clamping members movable over portions of the worktable in at least X and Y axes under control by the automatic control to present desired portions of a workpiece engaged by the clamping members at the work station, the improvement of: a loading device having means for:

(a) selectively segregating a workpiece from a stack of workpieces, (b) moving a segregated workpiece from the stack to a predetermined general area of the worktable and, (c) depositing the segregated workpiece on the worktable in the predetermined general area, said loading means being responsive to control signals from the automatic control, second means for gauging the deposited workpiece in a first of the X and Y axes, third means for gauging the workpiece in a second of the X and Y axes different than the first of the X and Y axes after gauging by the second means, said second and third means being under control of the automatic control and being sequentially actuated, and the second and third means each including controlled movement of the clamping members with respect to the worktable in at least one axes direction.

6. The improvement of claim 5 further including forth means for unloading the workpiece from the worktable, said fourth means being under control of the automatic control, said central control being effective to automatically load a workpiece onto the worktable, gauge the workpiece with respect to the machine tool, sequence the gauged workpiece through the machine tool while performing production operations thereon, and unload the completed workpiece from the table, all without human intervention.

7. A machine tool device comprising a machine tool with a worktable positioned adjacent thereto for supporting a workpiece for presentment to the tool, a workpiece gripping carriage associated with the workpiece including workpiece gripping members engageable with a workpiece on the worktable, control means including an automatic central control and carriage movement motors under control of the automatic central control for causing movement of the workpiece gripping members with respect to the worktable and machine tool, a workpiece loading device under control of the automatic central control effective to segregate a workpiece from a stack of workpieces adjacent to worktable and to move the segregated workpiece to a general area of the worktable and to deposit the segregated workpiece in the general area, and means for gauging the deposited workpiece in X and Y axes directions on the worktable, said means for gauging including first command means associated with the automatic central control for causing movement of the workpiece gripping members in a first direction from a position adjacent the general area to a predetermined position with the gripping members located within the general area, sensing means sensing engagement of an edge of the workpiece with the clamp gripping members in the general area and providing a signal to cause gripping of the workpiece by the gripping members, and second command means associated with the automatic central control for causing movement of the workpiece gripping members, in gripping engagement with the workpiece, in a second direction, normal to the first direction, and third means associated with the central controller for accepting reference points for further movement of the workpiece gripping members in dependent response to activation of the sensing means and to a sensing of the position of the workpiece caused by the movement in the second direction.

8. A turret punch machine equipped with a plurality of tools selectively actuatable to work on a workpiece at a machine work station, the machine comprising in combination, a workpiece support table, a workpiece clamping device having clamps movable in X and Y axes directions with respect to the work station under the control of an automatic controller, the controller controlling selection and actuation of the tools, an automatic loading device effective to load one workpiece from a stack of workpieces onto a portion of the table under the control of the controller, control means associated with the controller for causing the clamps to move into engagement with the workpiece and to move the workpiece and to clamp the loaded workpiece with the clamps being in a predetermined position in one of the axis directions at the time of the clamping whereby the workpiece is gauged in the one axis at the position of clamping, second means for automatic second axis gauging of the position of the loaded workpiece, said second means including a workpiece position sensing device operatively connected to the controller to determine positioning of the workpiece in the other axis direction after loading, said second means having a portion thereof at a fixed position relative to the table and the work station, and an automatic unloading sequence effective to unclamp the workpiece from the carriage at a predetermined position on the table and third means to unload the workpiece from the table at a side of the table under the control of the controller whereby loading, clamping, gauging, workpiece moving with respect to the work station, tool selection and activation, unclamping and unloading are all automatically controlled.

9. An apparatus including a numerically controlled sheet workpiece machine tool assembly and an automatic workpiece feeding assembly;

said numerically controlled machine tool assembly having workpeice clamping means, a working station, means for moving said workpiece clamping means in each of two perpendicular horizontal directions with respect to said working station, a table, means for moving a workpiece on said table into operative association with said clamping means, and device positioned to be contacted by the workpiece in both of said directions to locate the workpiece for subsequent position controlled movement by the clamping means, at least one of said devices including sensing means mounted in association with said clamping means for sensing the movement of a workpiece into operative association therewith to activate said clamping means;

said automatic workpiece feeding assembly comprising a storage area located on one side of said table for receiving a stack of workpieces to be fed to said machine tool assembly, means associated with said storage area for horizontally feeding workpieces one at a time in a feed direction from the storage area to said machine tool assembly to be moved into operative association with said clamping means and to be located with respect to said working station, and unload device located on the opposite side of said table in the direction of feeding movement of workpieces; from said storage area for receiving a workpiece to be removed from said machine tool assembly after release by said clamping means, and means for directing workpieces from said table to said unload device; and automatic means for controlling said working station and all of said means and devices of said assemblies in automatic coordinated sequential relation, so that the sheet workpieces are automatically and continuously and seriatim fed from said storage area onto said table, moved into working position with respect to said working station, worked on in said working station, and then moved to and unloaded by said unload device, all without any intervening operator assistance.

10. An apparatus according to claim 9, wherein said means for directing workpieces from said table to said unload stacker comprises a device controlled by said automatic means for engaging a workpiece from the machine tool assembly after the workpiece has been worked on in said working station, and for shunting the workpiece into stacking relationship with a stack of workpieces in the unload stacker.

11. A sheet material workpiece working machine tool of the type having at least one work station and a workpiece; supporting table adjacent to work station for supporting a workpiece for movement in two axis directions with respect to the work station with workpiece grasping and moving means including gripper means associated with the table for moving the workpiece with respect to the work station to present selected portions of the workpiece to the work station to perform work thereon thereat, comprising:

an automatic workpiece loading device and an automatic workpiece remainder unloading device associated with said table;

an automatic control device controlling said loading and unloading devices, said grasping and moving means and said work station;

said loading device having means for sorting a single workpiece from a store of workpieces and loading the workpiece onto said table in a general area of the table in a non-fully gauged condition of the workpiece with respect to said work station;

means for gauging the workpiece on said table by moving the workpiece on the table in at least one axis direction from said general area to a gauged position;

sensor device for sensing the arrival of the workpiece at the gauged position by contact between an edge of the workpiece and the sensor device for and inputting a signal to the control device from the sensor device;

said gripper means being operable for holding the workpiece at the gauged position with the position of the gripper means known to the control device when the workpiece is at the gauged position and the gripper means are in gripped relation to the workpiece, and the control device being operative to use such known position as a reference for controlling further movement of the gripper means and the gripped workpiece;

said gripper means being movable in X and Y axes directions for moving the workpiece over the table to present selected portions of the workpiece to the work station for performing work ont he workpiece comprising removing portions of the workpiece from remaining portions of the workpiece;

said gripper; means being operable for moving the remaining portions of the workpiece to an unloading area association with said unloading device for removing the remaining portions of the workpiece from the table and from the machine tool by the unloading device.

12. Apparatus according to claim 11, including sensors for sensing an edge of the workpiece in each of the X and Y axes when the edge of the workpiece is at a predetermined position in the associated axis, and the sensor outputting a signal to the control device when the associated edge is at a predetermined position in the associated axis.

13. Apparatus according to claim 11, wherein said gripper means is located away from said general area prior to loading of the workpiece onto said table, means operable after said loading for moving the gripper means in a first axis direction towards said general area, a first sensor for sensing contact between the gripper means and an edge of the workpiece, means for moving the gripper means to a predetermined position in the first axis direction and for effecting gripping of the workpiece by the gripper means at the predetermined position and for thereafter moving the gripper means and workpiece in a second axis direction until a second edge of the workpiece contacts a second sensor, said second sensor outputting a signal to the control device identifying within the control device the position of the gripper means when the signal is outputted from said second sensor, the control device operating to use the identified position as a position factor in controlling further movement of the workpiece with respect to the work station.

14. A machine tool controlled by a controller and having a working station at which a tool acts upon a workpiece, comprising:

a workpiece support table adjacent to said working station;

a workpiece movement gripper assembly having workpiece grippers, and associated with the table and controlled by said controller for controlled movement of the workpiece on the table by the gripper assembly for presenting successive selected portions of the workpiece to the working station;

a loader for loading workpiece sheets, a single sheet at time, from a stack of such sheets onto the worktable;

said loader including means for loading a single workpiece sheet onto the worktable and depositing the sheet on the worktable in a non-fully gauged position of the sheet on the worktable and where the relative position of any two edges of the sheet normal to one another is known to the controller, said relative position being in relation to a base line system for controlled movement of the sheet by the grippers;

automatic means for moving the workpiece on the worktable under command of the controller from the non-fully gauged position to a fully gauged position;

sensor means having a position known to the controller for sensing the arrival of the workpiece at the fully gauged position and for inputting a signal to the controller for indicating the presence of at least a portion of the sheet at the sensor means position, the fully gauged position being a position where the position of at least portions of the two edges of the sheet normal to one another are known to the controller;

said grippers being operable for gripping the workpiece at the fully gauged position with the position of the gripper assembly known to the controller when the workpiece is at the fully gauged position and the grippers are gripping the workpiece;

and said gripper assembly being caused to move under the command of the controller for moving the workpiece on the worktable relative to the work station, using the position of the gripper assembly at the fully gauged position as a reference position for the controller for commanding such moving relative to the work station.

15. Apparatus for processing and handling a workpiece in a fully automatic machine tool under the control of a controller, comprising:

means for separating a sheet of material from a stack of material adjacent to a worktable for the machine tool and for moving the separated sheet to a first position on the worktable in an ungauged position;

means for moving the sheet on the worktable from the ungauged position to a fully gauged position automatically under the control of said controller;

sensors carried in association with the worktable for sensing the presence of the sheet at the fully gauged position;

means for inputting a signal to the controller from the sensors for locating within the controller the position of grippers when the sheet is at said fully gauged position, and wherein the controller knows the position of the grippers when the signal is inputted;

means for causing the grippers to grip the sheet at said sensed fully gauged position with the grippers at a position which is the position located within the controller;

said grippers being operable to move the sheet with respect to a work station of the machine tool for performing work on the sheet in the work station and the controller referencing movement of the grippers in relation to the position of the grippers as located in the controller.

16. A fully automatic machine tool adapted for processing and handling a workpiece in predetermined stages, and with a controller controlling the charging and removing of the workpieces onto or away from the machine tool and the handling of the workpieces in the machine tool and including charging a workpiece individually from a stack of the workpieces onto a worktable, acting upon the workpiece by means of a tool at the work station associated with the worktable, handling the workpiece by means of grippers which are movable in the X and Y axes relative to the worktable while selected portions of the workpiece are moved into the work station, removing the workpiece from the worktable after acting on the workpiece by the machine tool, and coordinating the processing the handling stages with each other, comprising:

means for depositing the workpieces freely on the worktable in a general area thereof in a not fully gauged position adjacent to the workpiece grippers;

means for automatically moving the workpiece on the worktable from said general area by command of the controller to a fully gauged position in accordance with signals from a gauge arrangement associated with the worktable;

means for sensing the presence of the workpiece at the fully gauged position by engagement with the sensing means;

and said grippers gripping the workpiece at the fully gauged position and imparting knowledge of the position of the grippers relative to the workpiece to the controller when the workpiece is at the fully gauged position.

17. An assembly including a numerically controlled turret punch and an automatic workpiece feeding assembly:

said numerically controlled turret punch having workpiece clamping means;

a punching station;

means for moving said workpiece clamping means in each of two perpendicular horizontal directions with respect to said punching station;

a table;

means for moving a workpiece on said table into operative association with said clamping means;

and sensing means mounted on said clamping means for sensing the movement of a workpiece into operative association therewith to activate said clamping means;

and said automatic workpiece feeding assembly comprising a loader magazine, located on one side of said table receiving a stack of workpieces to be fed to said turret punch;

means associated with said loader magazine for horizontally linearly feeding workpieces one at a time in a feed direction from the loader magazine to said turret punch to be moved into operative association with said clamping means;

an unloader magazine, located on the opposite side of said table in the direction of linear feeding movement of workpieces from said loader magazine, for receiving a stack of workpieces to be received from said turret punch after release by said clamping means;

an automatic means for controlling said feeding device with respect to said loader magazine, and for controlling said unloader magazine in the transfer of each workpiece in the stack from said loader magazine to said turret punch and to said unloader magazine.

18. An assembly according to claim 17, wherein said unloader magazine comprises means for engaging a workpiece from the turret punch and shunting the workpiece into stacking relationship with the stack of workpieces in the unloader magazine.

* * * * *